US005433683A

United States Patent [19]

Stevens

[11] Patent Number: 5,433,683

[45] Date of Patent: Jul. 18, 1995

[54] SKI EXERCISER WITH SENSOR SYSTEM

[76] Inventor: Clive G. Stevens, 2nd Floor No. 3, Alley 25, Lane 208, Ruey An Street, Taipei, Taiwan

[21] Appl. No.: 239,793

[22] Filed: May 9, 1994

Related U.S. Application Data

[63] Continuation-in-part of Ser. No. 153,418, Nov. 15, 1993.

[51] Int. Cl.[6] ..... A63B 21/00; A63B 23/00

[52] U.S. Cl. ..... 482/70; 482/8; 482/902

[58] Field of Search ..... 482/51, 52, 53, 902, 482/903, 54, 70, 72, 901

[56] References Cited

U.S. PATENT DOCUMENTS

| | | | |
|---|---|---|---|
| 4,735,410 | 4/1988 | Nobuta | 482/902 |
| 4,867,447 | 9/1989 | Johnson | 482/72 |
| 4,934,694 | 6/1990 | McIntosh | 482/903 |
| 4,938,474 | 7/1990 | Sweeney | 482/52 |
| 5,230,418 | 7/1993 | Agnoff | 482/54 |
| 5,230,677 | 7/1993 | Chi | 482/70 |
| 5,277,678 | 1/1994 | Friedebach et al. | 482/70 |

*Primary Examiner*—Stephen R. Crow

*Attorney, Agent, or Firm*—Norman E. Lehrer; Jeffrey S. Ginsberg

[57] ABSTRACT

The belt which normally interconnects the two foot supports of a cross-country ski exercising machine passes around at least one pulley so as to rotate the pulley in an oscillating manner as the foot supports move back and forth. A slotted wheel rotates with the pulley and a photo-detecting unit is mounted on the frame for the exercise machine so as to cooperate with the slotted wheel. The photo-detecting unit includes two photo emitters and two photo receivers. Light from the photo emitters is intermittently received by the photo receivers as the openings in the slotted wheel move between the photo emitters and the photo receivers. This sensor system is capable of determining the extent of movement of the foot supports which, when connected to an information control unit, can provide precise exercise information such as the amount of distance actually covered and the number of calories consumed.

1 Claim, 1 Drawing Sheet

SKI EXERCISER WITH SENSOR SYSTEM

CROSS-REFERENCE TO RELATED APPLICATION

This application is a continuation-in-part of prior application Ser. No. 153,418, entitled "Stepper with Sensor System," filed Nov. 15, 1993.

BACKGROUND OF THE INVENTION

The present invention is directed toward a ski exercise machine and more particularly, toward a cross-country type ski machine which includes a sensor system capable of monitoring exercise performance and which can generate corresponding exercise information.

In Applicant's prior application, Ser. No. 153,418, it was explained that it is important when exercising to have some degree of monitoring or feedback of the exerciser's progress or performance. Information such as the distance traveled or the speed is essential. The prior application described a conventional stepper and explained that in conventional systems, the monitoring equipment consists essentially of a magnetic reed switch which turns on and off as a step passes the same. In addition to the mechanical drawbacks of a magnetic reed switch and failures due to the mechanics thereof, the prior application points out that a reed switch serves only as a counter since it can only generate "on" or "off" signals.

Thus, some exercise information, such as the amount of calories consumed, cannot be determined accurately because this requires additional information which the reed switch cannot provide such as the extent of the angular movement of the foot pedals of the stepper. Similarly, the reed switch, when used with stepper machines, cannot sense the speed of the movement of the foot pedals. Thus, a slow, short rotation of the foot pedals cannot be distinguished from a fast, long rotation of the same. As a result, the amount of exercise effort determined is inaccurate.

In order to improve on conventional stepper machines, Applicant's prior application describes a sensor system which more accurately monitors exercise performance and is capable of generating more precise exercise information. The sensor system described therein is comprised of a photo-detecting unit, a slotted wheel and an information control unit. The photo-detecting unit is mounted on the stepper frame assembly and includes photo emitters and photo receivers aligned therewith and adapted to receive light from the emitters. The slotted wheel is mounted so as to be rotatable along with the movement of one of the foot pedals and has a flange member which extends between the photo emitters and the photo receivers. Movement of the foot pedal moves the slotted wheel so that the slots therein interrupt the light passing from the photo emitters to the photo receivers thereby generating an electrical signal which represents the position, movement and speed of movement of the foot pedal. This provides much more accurate information than conventional systems which allows for more precise calculations of exercise information.

Conventional cross-country ski exercise machines suffer from substantially the same drawbacks as conventional steppers. That is, such ski machines which normally employ a pair of foot support means which are mounted so as to move forwardly and backwardly lack a sensor system that is dependable and will provide necessary exercise information. Such conventional systems include sensors that also utilize magnetic reed switches which suffer from the same drawbacks as the reed switches utilized with conventional steppers. That is, they may suffer from mechanical breakdown after prolonged use and are also capable of generating only an "on" or "off" signal. They cannot provide information such as the full extent of movement of the foot support means or the speed of movement thereof.

SUMMARY OF THE INVENTION

The purpose of the present invention is to overcome the deficiencies of prior art cross-country ski machines described above by adapting the improved sensor system of Applicant's prior application to cross-country ski machines. According to the invention, the belt which normally interconnects the two foot supporting means of a cross-country ski exercising machine passes around at least one pulley so as to rotate the pulley in an oscillating manner as the foot support means move back and forth. A slotted wheel rotates with the pulley and a photo-detecting unit is mounted on the frame for the exercise machine so as to cooperate with the slotted wheel. The photo-detecting unit includes two photo emitters and two photo receivers. Light from the photo emitters is intermittently received by the photo receivers as the openings in the slotted wheel move within the space between the photo emitters and the photo receivers. This sensor system is capable of determining the extent of movement of the foot support means which, when connected to an information control unit, can provide more precise exercise information such as the amount of distance actually covered and the number of calories consumed.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
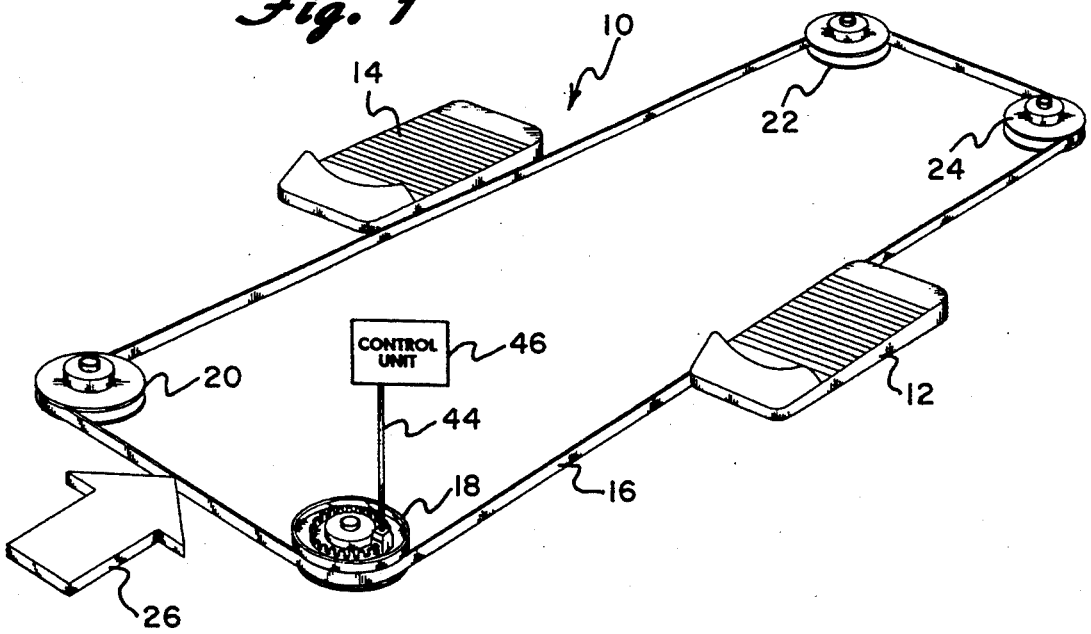
FIG. 1 is a schematic representation of the relevant portions of a cross-country ski exercise machine in combination with the sensor system of the present invention.

Referring now to the drawings in detail wherein like reference numerals have been used throughout the various figures to designate like elements, there is shown in FIG. 1 a schematic representation of a cross-country type ski exercise machine designated generally as 10. The exercise machine 10 shown in FIG. 1 illustrates only the operative components necessary to explain the details of the present invention. There are, of course, numerous support members, frame component parts, arm levers and the like which would be included in a fully operable machine. However, these various other features are conventional and are utilized in substantially all cross-country type ski exercise machines. Since such machines are well known in the art, a detailed description of the general operation of such a machine and the various component parts is not believed to be necessary. The following description will, therefore, be directed primarily only toward those component parts which are necessary to an understanding of the preferred embodiment of the present invention.

The ski exercise machine 10 includes a pair of spaced apart left and right foot support means 12 and 14, respectively. The foot support means 12 and 14 are mounted on rollers which will run on a track or frame or the like or other substantially horizontally arranged support surface so that the support means will be freely movable forward and back as the person standing thereon moves his feet forward and back.

The foot support means 12 and 14 are interconnected to each other by an endless belt 16 which passes around pulleys 18, 20, 22 and 24, each of which is mounted for rotation about a vertical axis. As a result of the belt 16 and the pulleys, as foot support means 12 is moved forwardly by the user, foot support means 14 must move rearwardly. Similarly, as foot support means 12 is moved rearwardly, foot support means 14 is moved forwardly in the known manner.

As the foot support means 12 and 14 are moved forwardly and rearwardly, the pulleys 18, 20, 22 and 24 are made to rotate or oscillate about their vertical axes. The pulleys are normally mounted for free rotation about their respective axes. A friction system schematically represented at 26 can be applied to the belt at the forward end of the machine or at substantially any other point along the belt in order to restrict the free travel of the belt and thereby provide resistance to the user standing on the foot support means 12 and 14.

The sensor system of the present invention is shown incorporated into the pulley 18. It should be readily apparent, however, that any one of the other pulleys could also be utilized. The details of the sensor system are shown more clearly in FIG. 2 to which reference will now be made.

Figure 2:
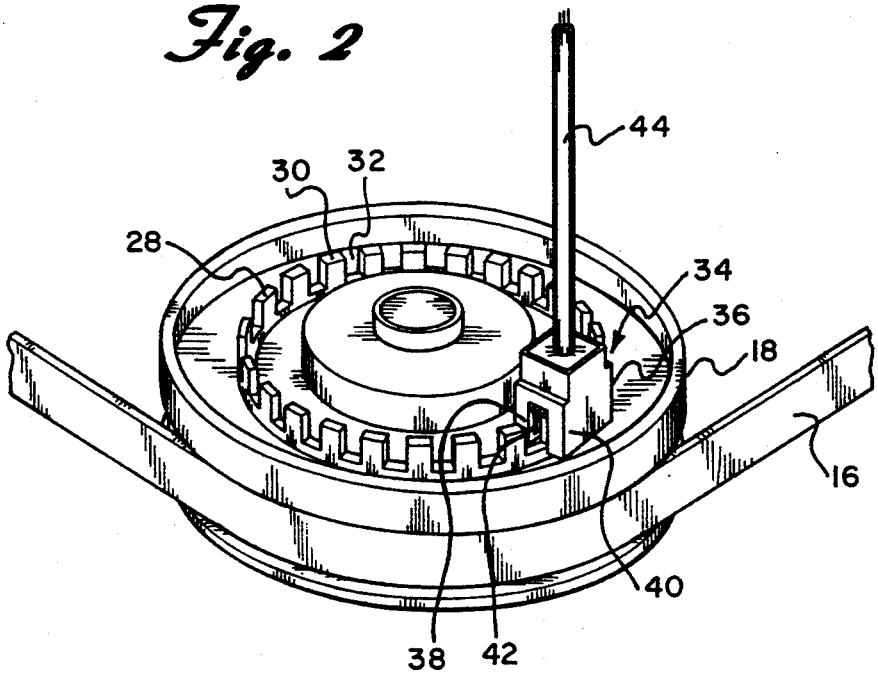
FIG. 2 is an enlarged perspective view showing the details of the sensor system.

As shown most clearly in FIG. 2, a slotted wheel 28 is secured to the upper surface of the pulley 18. The slotted wheel 28 includes a plurality of spaced apart teeth-like elements 30 having openings 32 therebetween. These elements 30 are arranged around the wheel 28 and extend upwardly in an axial direction parallel to each other and perpendicular to the plane of the wheel.

The sensor system also includes a photo-detecting unit 34 which includes a hollow housing 36 comprised of two opposed extensions 38 and 40 having a gap 42 remaining therebetween. Mounted on the inner surface of extension 38 are a pair of photo emitters (not shown) which preferably emit infrared light. Similarly, a pair of photo receivers (not shown) are mounted on the inner surface of the extension 40. The photo emitters and photo receivers are arranged such that light from the first photo emitter would normally be received by the first photo receiver and light from the second photo emitter would normally be received by the second photo receiver.

The photo-detecting unit 34 is mounted over the slotted wheel 28 so that the teeth 30 and spaces 32 therein pass through the gap 42. In this way, the teeth 30 prevent light from passing from a photo emitter to its respective photo receiver and the openings 32 allow light to be received intermittently as the slotted wheel rotates. Preferably, the photo-detecting unit 34 is securely mounted onto a fixed portion of the frame or other structural support for the exercise machine. An electrical cable 44 delivers information from the sensor 34 to a micro-processor control unit 46 located in an exercise monitor mounted on the ski machine.

The sensor of the present invention including the slotted wheel 28 and the photo-detecting unit 34 operate in substantially the same manner as described in Applicant's prior application and the entire subject matter thereof is incorporated herein by reference. As is explained in Applicant's prior application, the size of the teeth 30, the openings 32 and the spacing between the two photo emitters (and also the photo receivers) are such that, when one of the photo emitters is aligned with one of the openings 32, the other of the photo emitters is in alignment with one of the teeth 30. This enables the sensor system to determine the direction of movement of the pulley 18 and, thus, the foot support means 12 and 14. That is, if the direction of movement of the pulley 18 is changed, the photo receiver that was receiving infrared light first during the motion in one direction receives it last when the slotted wheel 28 moves in the opposite direction. Thus, the sensor system of the present invention is capable of determining not only the direction of movement of the foot support means but also the full extent of movement thereof. Furthermore, with information from a timer in the exercise monitor, the speed can be determined and in combination with the amount of resistance being applied, the number of calories burned can also be calculated.

The present invention may be embodied in other specific forms without departing from the spirit or essential attributes thereof and accordingly reference should be made to the appended claims rather than to the foregoing specification as indicating the scope of the invention.

I claim:

1. A ski machine with a sensor system that is adapted to monitor exercise performance and generate exercise information said ski machine including first and second foot support means; each of said foot support means being adapted to move substantially in a single plane forwardly and rearwardly; means interconnecting said first and second foot support means so that when one of said foot support means is moving rearwardly, the other of said foot support means is moving forwardly; said interconnecting means including a belt and at least one pulley, said belt passing around and being in contact with said pulley so as to rotate said pulley in response to movement of said belt; said sensor system including a slotted wheel carried by and rotatable with said pulley, said slotted wheel including a plurality of spaced apart teeth-like elements arranged around said wheel and extending parallel to each other in an axial direction and perpendicular to the plane of said wheel; said sensor system further including a photo emitter located on one side of said elements and a photo receiver adapted to receive light from said photo emitter located on the other side of said elements whereby the transmission of light from said photo emitter to said photo receiver is interrupted by said elements when said wheel is rotated, and an instrument control unit electrically connected to said photo receiver so as to process signals from said photo receiver and generate exercise information based on said signals.

* * * * *